United States Patent [19]

Mollet

[11] 4,125,402

[45] Nov. 14, 1978

[54] METHOD OF PROCESSING SILVER DYE BLEACHING MATERIALS AND PREPARATIONS SUITABLE FOR THE DYE AND SILVER BLEACHING

[75] Inventor: Herbert Mollet, Tentlingen, Switzerland

[73] Assignee: Ciba-Geigy AG, Basel, Switzerland

[21] Appl. No.: 824,201

[22] Filed: Aug. 12, 1977

[30] Foreign Application Priority Data

Aug. 19, 1976 [CH] Switzerland ..... 10561/76

[51] Int. Cl.[2] ..... G03C 7/00; G03C 5/32

[52] U.S. Cl. ..... 96/53; 96/60 R

[58] Field of Search ..... 96/53, 60 R, 60 BF

[56] References Cited

U.S. PATENT DOCUMENTS

| | | | |
|---|---|---|---|
| 2,322,084 | 6/1943 | Young et al. | 96/53 |
| 2,943,935 | 7/1960 | Welliver | 96/60 R |
| 3,414,411 | 12/1968 | Michel et al. | 96/53 |
| 3,607,277 | 9/1971 | Schranz et al. | 96/60 R |
| 3,716,362 | 2/1973 | Meier | 96/53 |
| 3,879,202 | 4/1975 | Yamaguchi | 96/60 BF |
| 3,961,957 | 6/1976 | Kramp et al. | 96/53 |
| 3,963,492 | 6/1976 | Marthaler et al. | 96/53 |
| 4,014,698 | 3/1977 | Marthaler | 96/53 |
| 4,033,771 | 7/1977 | Borton et al. | 96/60 BF |

*Primary Examiner*—J. Travis Brown

*Attorney, Agent, or Firm*—Sprung, Felfe, Horn, Lynch & Kramer

[57] ABSTRACT

A method of processing silver dye bleaching materials is provided wherein a combined aqueous dye and silver bleaching bath is used which contains a strong acid, a water-soluble iodide, a dye bleaching catalyst, a water-soluble oxidant and an antioxidizing agent, wherein the antioxidizing agent is an alkali metal, alkaline earth metal or ammonium bisulphite adduct of an organic carbonyl compound. The dye and silver bleaching can also be carried out in separate baths and then the aqueous dye bleaching bath contains a strong acid, a water-soluble iodide, a dye bleaching catalyst and the antioxidizing agent, which is again said bisulphite adduct. The strongly acid baths which contain as antioxidizing agents the bisulphite adducts are stable over a lengthy period of time, exert a lasting antioxidizing action and are free of offensive odors.

18 Claims, No Drawings

METHOD OF PROCESSING SILVER DYE BLEACHING MATERIALS AND PREPARATIONS SUITABLE FOR THE DYE AND SILVER BLEACHING

It is known that, during the silver dye bleaching process, dyes which are present in the photographic layer are reductively bleached in the presence of imagewise distributed, developed metallic silver, resulting in the formation of a dye image which is similar to the original or is the converse of the silver image. The preparations used for this process are usually aqueous solutions which contain a strong acid, a silver complexing agent, for example thiourea or an alkali halide, and, in most cases, also a dye bleaching catalyst which initiates the reaction between the image silver and the dye to be reduced. The processing of silver dye bleaching materials usually comprises the steps: silver developing, dye bleaching, silver bleaching, silver fixing and washing. The dye bleaching and silver bleaching can also be carried out in one bath.

However, experience has shown that dye bleaching preparations which contain thiourea as complexing agent are highly corrosive and for this reason give rise to problems in actual practice. For ecological reasons, thiourea is also undesirable on account of its poisonous nature. Preference is therefore given to those preparations which contain an alkali halide, in particular iodide, as complexing agent. Corresponding compositions are described for example in German Auslegeschrift 1,158,368 or in Swiss patent specification 508,899.

On the other hand, it is known that dye bleaching preparations which contain iodide ions are very susceptible to oxidation. As a result of the action of atmospheric oxygen, iodide is oxidised to iodine. The consequence is that the photographic results become unreliable and poorly reproducible after a short time and the activity of the bleaching preparation diminishes. Various proposals have therefore been made to stabilise the preparations by adding an antioxidising agent.

In British patent specification No. 630,222, for example, the proposal is made to add hypophosphite as antioxidising agent. However, the reaction of hypophosphite with iodine proceeds relatively slowly and therefore provides only an insufficient protection of the preparation. In German Offenlegungsschrift No. 2,044,994, the proposal is made to use oximes of organic carbonyl compounds, such as cyclohexanonoxime. Swiss patent specification No. 508,899 suggests the use of reductones, such as ascorbic acid and similar compounds. Such compounds afford good protection against oxidation: however, it is evident that they are only able to provide an inadequate protection of the equipment used for the processing against the corrosion caused by the strongly acid preparations.

Finally, the use of mercapto compounds, such as thiomalic acid or thioglycerol, as antioxidising agents has also been described. These compounds too afford only insufficient protection against the corrosion of metallic devices. In this respect, compounds of the mercaptobutyric acid or mercaptopropionic acid type which are described for example in German Offenlegungsschrift No. 2,423,814 prove to be better. A disadvantage of such mercapto compounds is their unpleasant odour and partial poor solubility, for which reason efforts have been made to find antioxidising agents which do not have the above disadvantages.

It has been found that stable preparations which are substantially unsusceptible to oxidation are obtained by adding the bisulphite adduct of an organic carbonyl compound to the preparations. Such compounds dissociate in aqueous sulphite solution to a very slight extent to give bisulphite ions and the corresponding carbonyl compound. Sulphurous acid, which dissociates to water and $SO_2$, forms in acid solution. An insignificant amount of free sulphur dioxide is therefore constantly present in acid aqueous solutions of such bisulphite adducts. The sulphur dioxide reacts momentarily with elementary iodine which is set free from the iodine by oxidation and in the process is irreversibly oxidised to sulphuric acid. However, the performance of the method of the invention is not limited to this reaction mechanism.

The antioxidising action of carbonyl-bisulphite adducts is known per se and is also utilised in photography. Accordingly, carbonyl-bisulphite adducts, preferably the adduct of formaldehyde with sodium bisulphite, are added for example to developer solutions for photographic high contrast materials - so-called "lith developers" - which contain chiefly hydroquinone, which is very susceptible to oxidation, in order to stabilise the developer solution against oxidation. These solutions are, however, strongly alkaline and it was not be expected that the carbonyl-bisulphite adducts dissociate only to a small degree in strongly acid preparations with a pH value which in most cases is below 1, or that they are stable over a lengthy period of time and consequently exert a lasting antioxidising action in the bleaching bath. The dissociation to bisulphite and also the consequent formation of $SO_2$ is so insignificant that no offensive odour occurs.

It is also surprising that the carbonyl-bisulphite adducts prove to be useful antioxidising agents also in those dye bleaching preparations which, in addition to the cited constituents, contain a strong oxidant, such as an aromatic nitro compound, for example a mono- or dinitrobenzenesulphonic acid, and remain stable in the solution over a prolonged period of time. Such preparations, which in addition to a strong acid contain a silver complexing agent and an oxidant as well as a bleaching catalyst in a relatively high concentration, are used in so-called three- and two-bath processes for the simultaneous bleaching of dye and image silver. Such silver dye bleaching processes are described for example in German patent specification No. 735,672 or in German Offenlegungsschrift No. 2,448,433. In the case of the two-bath processes, the preparations additionally contain a sufficient amount of a soluble fixing agent which forms silver complexes, so that dye and silver bleaching, as well as the fixing of the entire silver present, are carried out in a single step.

Accordingly, the present invention provides a method of processing silver dye bleaching materials using a combined aqueous dye and silver bleaching bath which contains a strong acid, a water-soluble iodide, a dye bleaching catalyst, a water-soluble oxidant and an antioxidising agent, wherein the antioxidising agent is an alkali metal, alkaline earth metal or ammonium bisulphite adduct of an organic carbonyl compound. If the dye and silver bleaching is carried out in separate baths instead of in a combined aqueous dye and silver bleaching bath, then the aqueous dye bleaching bath contains a strong acid, a water-soluble iodide, a dye bleaching catalyst and an antioxidising agent, in which case the antioxidising agent is again the cited bisulphite adduct.

Suitable carbonyl-bisulphite adducts for the manufacture of the dye bleaching preparation are in particular the adducts of alkali metal, alkaline earth metal or ammonium bisulphite, preferably of sodium, potassium or ammonium bisulphite with low molecular aldehydes (mono- or dialdehydes) or ketones having not more than 5 carbon atoms, such as in particular the monoaldehydes having 1 to 4 carbon atoms, for example formaldehyde, acetaldehyde, propionaldehyde, butyraldehyde or isobutylaldehyde, or the dialdehydes having 2 to 5 carbon atoms, for example glyoxal, malondialdehyde or glutardialdehyde, or ketones, for example acetone. The aldehydes having 1 to 5, preferably 1 to 4, carbon atoms are preferred.

Particularly stable carbonyl-bisulphite compounds which dissociate only to an insignificant degree in aqueous solution and thus yield virtually no free bisulphite ions and free sulphur dioxide, are usually the adducts with aldehydes. The adduct of formaldehyde and bisulphite yields particularly stable aqueous solutions which dissociates to an insignificant degree and which are also stable under strongly acid conditions over a prolonged period of time. The adducts can be prepared in simple manner by mixing stoichiometric amounts of the aldehyde in question with, for example, concentrated sodium bisulphite solution.

By strong acids are meant in this context those which impart to the dye bleaching bath and/or the combined dye and silver bleaching bath a pH value not higher than 2. It is accordingly possible to use for example hydrochloric acid, phosphoric acid and, in particular, sulphuric acid or sulphamic acid.

A water-soluble iodide can be an alkali iodide, for example potassium or sodium iodide.

Suitable bleaching catalysts are in particular diazine compounds, for example those derivatives of pyrazine, quinoxaline or phenazine which are described in the literature. Suitable pyrazine and quinoxaline compounds are described in detail for example in German Offenlegungsschrift No. 2,448,433.

Examples of suitable oxidants for the two- and three-bath processes are azo dyes, for example tartrazine or Orange G (C.I. 16230), nitroso compounds, for example p-nitrosodimethyl aniline, nitro compounds, for example aromatic nitro compounds, preferably aromatic mono- or dinitrobenzenesulphonic acids of the formula

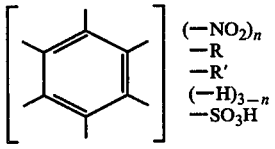

(1)

wherein $n$ is 1 or 2 and R and R' represent hydrogen, lower alkyl, alkoxy, amino or halogen. The sulphonic acids can be added in the form of readily soluble salts. Suitable readily soluble salts are for example the sodium or potassium salts of the following acids:

3-nitrobenzenesulphonic acid, 2,4-dinitrobenzenesulphonic acid, 3,5-dinitrobenzenesulphonic acid, 3-nitro-4-chlorobenzenesulphonic acid, 2-chloro-5-nitrobenzenesulphonic acid, 4-methyl-3,5-dinitrobenzenesulphonic acid, 3-chloro-2,5-dinitrobenzenesulphonic acid, 2-amino-4-nitrobenzenesulphonic acid, 2-amino-4-nitro-5-methoxybenzenesulphonic acid.

Instead of using the sulphonic acids it is also possible to use carboxylic acids, such as 3-nitrobenzoic acid, 3-nitrophthalic acid or 4-nitrophthalic acid. Polynuclear aromatic sulphonic acids, such as 2-amino-5-nitronaphthalene-4,8-disulphonic acid or 8-nitroanthraquinone-2-sulphonic acid, can also be used as oxidants. In addition, it is also possible to use suitably substituted naphthoquinones and anthraquinones. Anthraquinone compounds possess in many cases, even without substituting groups, sufficient oxidising action and can be used in the silver bleaching preparation. Accordingly, useful results are also obtained for example with anthraquinone-2-sulphonic acid or anthraquinone-2,5-disulphonic acid.

The temperature of the bleaching bath can be between 20° C and 90° C. In general it is advantageous to carry out the process at a temperature not higher than 60° C and for example between 30° and 40° C. It is, however, a further advantage of the process that it affords good images of normal colour balance at elevated temperature, for example at 50° C or still higher temperatures. The processing can be further shortened by the increase in temperature, but even under these conditions the baths still remain sufficiently stable for a sufficiently long period of time. The quantity ratios of the substances present in the bleaching bath can be varied within fairly wide limits and are advantageously chosen in accordance with known methods. The bleaching baths advantageously contain 5 to 20 g of iodide, 0.1 to 30 g of oxidant, 0.5 to 5 g of dye bleaching catalyst, and 0.5 to 50 g of antioxidising agent, per liter of bleaching bath.

The bleaching baths can contain as further additives for example hardening agents, wetting agents, fluorescent brighteners and UV absorbers.

The invention also provides the preparations for carrying out the method of the invention, i.e. for processing silver dye bleaching materials.

Suitable preparations for the combined dye and silver bleaching are in particular aqueous solutions which contain as basic constituents a strong acid, a water-soluble iodide, a dye bleaching catalyst, a water-soluble oxidant, and, as antioxidising agent, an alkali metal, alkaline earth metal or ammonium bisulphite adduct of an organic carbonyl compound.

The preparations for dye bleaching baths are also preferably aqueous solutions which contain a strong acid, a watersoluble iodide, a dye bleaching catalyst and, as antioxidising agent, an alkali metal, alkaline earth metal or ammonium bisulphite adduct of an organic carbonyl compound.

These solutions can be used as baths or also in the spray method (i.e. as spray solutions).

The preparations can also be obtained by dissolving concentrates of the individual components or mixtures thereof in water and optionally in further solvents. Suitable concentrates are for example concentrated solutions, aqueous pastes, powders or tablets. These concentrates can also contain only a part or a single component of the constituents, in particular the chemicals which are sparingly soluble or insoluble in water, in the form of dispersions or emulsions, with or without the addition of organic solvents.

The concentrates in powder or tablet form can optionally contain inert binders and/or swelling agents. For reasons of stability or for other reasons, it may be necessary in this case to manufacture the preparations or the concentrates suitable for obtaining them, in two or more separate portions and to keep them for example in separate containers and to mix these portions of the individual components or mixtures thereof shortly before use, with or without the addition of water, to give the ready for use preparation. Acid and oxidant are often for example kept separately from the other components in order to ensure an optimum stability of the concentrates.

Particularly suitable preparations contain as antioxidising agent an alkali metal, alkaline earth metal or ammonium bisulphite adduct of an aldehyde having not more than 5 carbon atoms. The alkali metal or ammonium bisulphite adducts of aldehydes having 1 to 5 carbon atoms are preferred. Preparations which contain the adduct of formaldehyde with sodium bisulphite are especially useful.

The dye bleach preparations of the present invention are distinguished by their high stability and their constant activity over a prolonged period of time. In addition, they have only slight corrosiveness and are free from unpleasant odours.

The process of the present invention can be used for example in the preparation of positive colour pictures in automatic printing machines or in automatic self-portrait machines or in the rapid processing of other silver dye bleaching materials, for example for scientific drawings and industrial purposes, for example colour photoradiography.

A transparent, metal-reflecting or preferably white-opaque material which is not able to absorb any fluid from the baths can be used as carrier for the silver dye bleach material.

The carrier can consist for example of pigmented or unpigmented cellulose triacetate or polyester. If it consists of felt paper, then this must be varnished on both sides or coated with polyethylene. The light-sensitive layers are on at least one side of the carrier, preferably in the known arrangement, i.e. at the bottom a layer of red-sensitised silver halide emulsion which contains a cyan azo dye, on top of this a layer of green-sensitised silver halide emulsion which contains a magenta azo dye, and at the top a layer of blue-sensitised silver halide emulsion which contains a yellow azo dye. The material can also contain bottom layers, intermediate layers, filter layers and protective layers. The image dyes and silver halide emulsions which are sensitised in the complementary colour and assigned to them can also be incorporated in separate, preferably adjacent layers, as described for example in Swiss patent specifications No. 526,134, 542,462 and 550,423.

The invention is illustrated by the following Examples.

EXAMPLE 1

A photographic material with three layers is prepared on a pigmented cellulose acetate carrier for the silver dye bleaching process. The material contains the cyan image dye of the formula

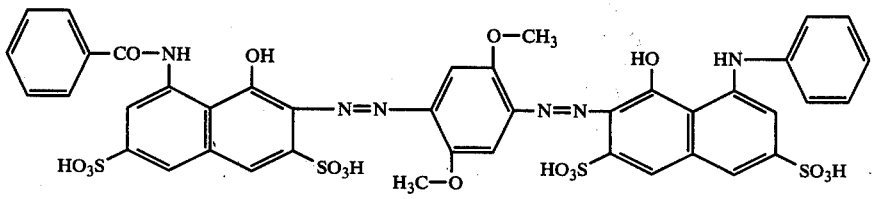

(101)

in the bottom layer, the magenta image dye of the formula

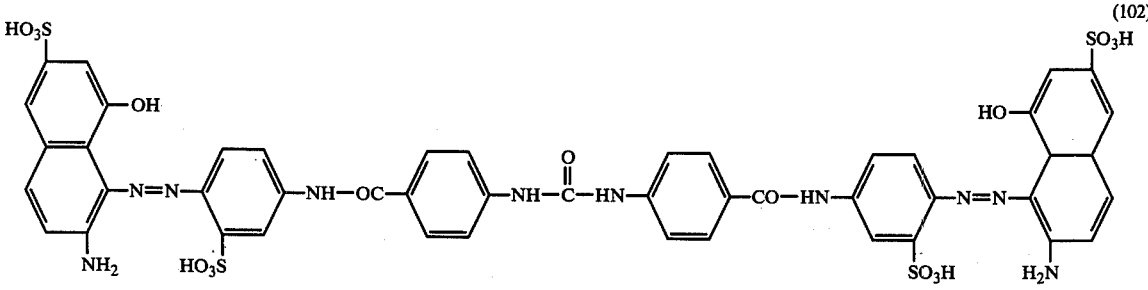

(102)

in the green-sensitised layer above this, and the yellow image dye of the formula

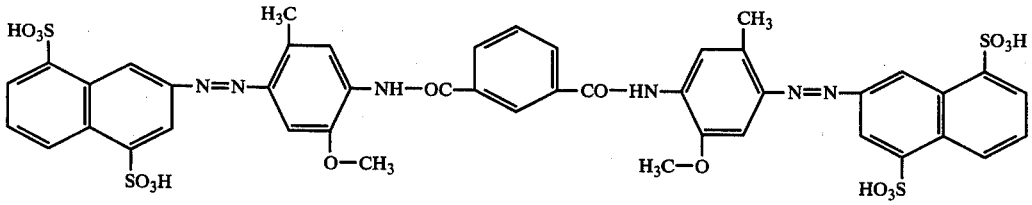

(103)

in the topmost blue-sensitised layer. The image dyes are incorporated into the emulsions in a reflection density of D = 2.0. The coloured layers having a total silver content of 2 g/m$^2$ are separated by gelatin layers and the total thickness of the layers is 22 $\mu$. The material is irradiated with blue, green and red light behind a step wedge and processed as follows at 24° C in a rotating drum:

| 1. Silver developing bath: | |
|---|---|
| sodium polyphosphate | 1 g/l |
| sodium sulphite, anhydrous | 50 g/l |
| hydroquinone | 5 g/l |
| sodium metaborate | 15 g/l |
| 1-phenyl-3-pyrazolidinone | 0.3 g/l |
| potassium bromide | 3 g/l |
| benztriazole | 0.2 g/l |
| Time: 6 minutes | |

2. Washing: 5 minutes

| 3. Dye bleaching bath: | |
|---|---|
| water | 800 ml |
| sulphamic acid | 60 g |
| sodium formaldehyde-bisulphite adduct $HO\text{-}CH_2SO_3Na$ (99.9%) | 10 g |
| potassium iodide | 25 g |
| catalyst: 2,3-dimethyl-5-amino-6-methoxy-quinoxaline | 0.1 g |
| bulked with water to | 1000 ml |
| Time: 7 ½ minutes | |

Instead of using the sodium formaldehyde-bisulphite adduct it is also possible to use the sodium acetatalde-hyde or sodium butyraldehyde-bisulphite adduct.

4. Washing: 4 minutes

| 5. Silver bleaching bath: | |
|---|---|
| water | 800 ml |
| potassium ferricyanide | 60 g |
| potassium bromide | 15 g |
| sodium hydrogen phosphate | 19 g |
| disodium hydrogen phosphate . $7H_2O$ | 10 g |
| conc. acetic acid | 10 g |
| bulked with water to | 1000 ml |
| Time: 3 minutes | |

6. Washing: 3 minutes

| 7. Fixing bath: | |
|---|---|
| ammonium thiosulphate | 200 g/l |
| sodium sulphite, anhydrous | 20 g/l |
| Time: 7 minutes | |

8. Washing: 8 minutes

After drying, an image which is the same as the original is obtained. By allowing the dye bleaching bath (3) to stand for two weeks in an open bottle and then using it again in the above processing method, images of the same quality (sensitivity, gradation, fog) are obtained. The activity of the dye bleaching bath thus remains constant over the given period of time. A dye bleaching bath of the above composition, but without sodium formaldehyde bisulphite as antioxidising agent, is unstable and discolours after a few days. Oxidation of the iodide to iodine causes the activity to diminish, so that the layer dyes can no longer be completely bleached. By passing 25 liters of oxygen gas per hour and per liter of dye bleaching bath through the dye bleaching bath (3), no marked change or decrease of activity can be ascertained after 25 hours. A dye bleaching bath of the same composition, but containing no sodium formaldehyde-bisulphite adduct, discolours after only a few hours and has a strongly diminished bleaching action.

EXAMPLE 2

A photographic multilayer material as described in Example 1 is irradiated behind a step wedge and processed at 24° C in a rotating drum. In this process, the dye bleaching and silver bleaching steps are comprised in a combined bath.

| 1. Silver developing bath: | |
|---|---|
| sodium polyphosphate | 1 g/l |
| sodium sulphite, anhydrous | 40 g/l |
| hydroquinone | 10 g/l |
| sodium metaborate | 20 g/l |
| sodium hydroxide | 3 g/l |
| 1-phenyl-3-pyrazolidinone | 1 g/l |
| potassium bromide | 1.5 g/l |
| benztriazole | 0.2 g/l |
| catalyst: 2,3,6-trimethyl-quinoxaline (added as 1% solution in methyl cellosolve) | 0.4 g/l |
| Time: 2 minutes | |

| 2. Dry bleaching-silver bleaching bath | |
|---|---|
| sulphamic acid | 100 g/l |
| sodium formaldehyde-bisulphite adduct | 10 g/l |
| ammonium iodide | 7 g/l |
| sodium m-nitrobenzenesulphonate | 10 g/l |
| catalyst: 2,3,6-trimethyl-quinoxaline | 3 g/l |
| Time: 4 minutes | |

Instead of using the sodium formaldehyde-bisulphite adduct it is also possible to use the sodium acetatalde-hyde or sodium butyralaldehyde adduct.

| 3. Fixing bath: | |
|---|---|
| ammonium thiosulphate | 200 g/l |
| sodium metabisulphite | 10 g/l |
| sodium sulphite | 40 g/l |
| Time: 4 minutes | |

4. Washing: 6 minutes

A positive image of the step wedge is obtained in this manner. The same result is obtained by carrying out the procedure with a combined bleaching bath (2) which has been kept for 4 weeks in an open bottle.

EXAMPLE 3

A photographic multilayer material as described in Example 1 is irradiated behind a step wedge and processed in accordance with Example 2. The combined dye bleaching-silver bleaching bath has, however, the following composition:

| | | |
|---|---|---|
| sulphamic acid | 140 | g/l |
| glutaraldehyde-bis-sodium bisulphite | 23 | g/l |
| potassium iodide | 6 | g/l |
| sodium m-nitrobenzenesulphonate | 6 | g/l |
| catalyst: 2,3,6-trimethyl-quinoxaline | 2 | g/l |

An image which is the same as the original is obtained in this manner. Images of the same quality (gradation, colour balance, fog) are obtained if the bleaching bath of the above composition is allowed to stand for 4 weeks in an open bottle. The activity of the dye bleaching-silver bleaching bath accordingly remains constant over the indicated period of time. Even after standing for 4 weeks in an open vessel, the combined bleaching bath is not discoloured. As against this, a precipitate in the form of violet brown needles consisting of a complex of iodine and the quinoxaline compound employed forms after only a few days in a bath of the same composition but without the addition of glutaraldehyde-bisulphite compound. The solution is thereby impoverished of both iodide ions and catalyst, and a gradually changed bleaching action with a corresponding displacement of the colour balance and of the gradation of the processed images results therefrom. Instead of using the glutaraldehyde-bis-sodium bisulphite adduct, it is also possible to use the glyoxal-bis-sodium bisulphite adduct with equally good results.

I claim:

1. A method of processing silver dye bleaching materials which method comprises employing a combined aqueous dye and silver bleaching bath which contains a strong acid in an amount sufficient to impart to the preparation a pH value of not more than 2, a water-soluble iodide, a dye bleaching catalyst, a water-soluble oxidant and an antioxidising agent, wherein the antioxidising agent is an alkali metal, alkaline earth metal or ammonium bisulphite adduct of an aldehyde or ketone.

2. A method according to claim 1 which method comprises employing an aqueous dye bleaching bath which contains a strong acid in an amount sufficient to impart to the preparation a pH value of not more than 2, a water-soluble iodide, a dye bleaching catalyst and an antioxidising agent, wherein the antioxidising agent is an alkali metal, alkaline earth metal or ammonium bisulphite adduct of an aldehyde or ketone.

3. A method according to either of claims 1 or 2, wherein the antioxidising agent is an alkali metal, alkaline earth metal or ammonium bisulphite adduct of an aldehyde or ketone having not more than 5 carbon atoms.

4. A method according to claim 3, wherein the antioxidising agent is an alkali metal or ammonium bisulphite adduct of an aldehyde having 1 to 5 carbon atoms.

5. A method according to claim 4, wherein the antioxidising agent is an alkali metal or ammonium bisulphite adduct of a monoaldehyde having 1 to 4 carbon atoms or of a dialdehyde having 2 to 5 carbon atoms.

6. A method according to claim 5, wherein the antioxidising agent is the adduct of formaldehyde with sodium bisulphite.

7. A preparation for carrying out the method according to claim 1 which contains as basic constituents a strong acid in an amount sufficient to impart to the preparation a pH value of not more than 2, a water-soluble iodide, a dye bleaching catalyst, a water-soluble oxidant and an antioxidising agent, wherein the antioxidising agent is an alkali metal, alkaline earth metal or ammonium bisulphite adduct of an aldehyde or ketone.

8. A preparation for carrying out the process according to claim 2 which contains as basic constituents a strong acid in an amount sufficient to impart to the preparation a pH value of not more than 2, a water-soluble iodide, a dye bleaching catalyst and an antioxidising agent, wherein the antioxidising agent is an alkali metal, alkaline earth metal or ammonium bisulphite adduct of an aldehyde or ketone.

9. A preparation according to either of claims 7 or 8, wherein the antioxidising agent is an alkali metal, alkaline earth metal or ammonium bisulphite adduct of an aldehyde or ketone having not more than 5 carbon atoms.

10. A preparation according to claim 9, wherein the antioxidising agent is an alkali metal or ammonium bisulphite adduct of an aldehyde having 1 to 5 carbon atoms.

11. A preparation according to claim 10, wherein the antioxidising agent is an alkali metal or ammonium bisulphite adduct of a monoaldehyde having 1 to 4 carbon atoms or of an aldehyde having 2 to 5 carbon atoms.

12. A preparation according to claim 11, wherein the antioxidising agent is the adduct of formaldehyde with sodium bisulphite.

13. A preparation according to claim 7 which is in the form of an aqueous solution.

14. A preparation according to claim 13 which contains, per liter, 5 to 20 g of a water-soluble iodide, 0.5 to 5 g of a dye bleaching catalyst, 0.5 to 50 g of the antioxidising agent, optionally 0.1 to 30 g of a water-soluble oxidant and a strong acid in an amount sufficient to impart to the preparation a pH value of not more than 2.

15. A dye and silver bleaching preparation in concentrate form which when diluted with water or water-organic solvent mixtures forms a preparation according to claim 7.

16. A dye bleaching preparation in concentrate form which when diluted with water or water-organic solvent mixtures forms a preparation according to claim 8.

17. The concentrated dye and silver bleach preparation according to claim 15 which is in the form of a concentrated solution, aqueous paste, powder or tablet.

18. The concentrated dye bleach preparation according to claim 16 which is in the form of a concentrated solution, aqueous paste, powder or tablet.

* * * * *